US010594085B2

(12) United States Patent
Trout et al.

(10) Patent No.: US 10,594,085 B2
(45) Date of Patent: Mar. 17, 2020

(54) ELECTRICAL CONNECTOR AND ELECTRICAL CONTACT CONFIGURED TO REDUCE RESONANCE

(71) Applicant: TE CONNECTIVITY CORPORATION, Berwyn, PA (US)

(72) Inventors: David Allison Trout, Lancaster, PA (US); Chad William Morgan, Carneys Point, NJ (US); Jeffrey Byron McClinton, Harrisburg, PA (US); Douglas Edward Shirk, Elizabethtown, PA (US)

(73) Assignee: TE Connectivity Corporation, Berwyn, PA (US)

( * ) Notice: Subject to any disclaimer, the term of this patent is extended or adjusted under 35 U.S.C. 154(b) by 97 days.

(21) Appl. No.: 15/696,613

(22) Filed: Sep. 6, 2017

(65) Prior Publication Data

US 2019/0074637 A1 Mar. 7, 2019

(51) Int. Cl.

| | |
|---|---|
| ***H01R 13/648*** | (2006.01) |
| ***H01R 13/6474*** | (2011.01) |
| ***H01R 25/00*** | (2006.01) |
| *H01R 13/115* | (2006.01) |
| *H01R 13/6587* | (2011.01) |

(52) U.S. Cl.

CPC ..... *H01R 13/6474* (2013.01); *H01R 25/006* (2013.01); *H01R 13/115* (2013.01); *H01R 13/6587* (2013.01)

(58) Field of Classification Search

CPC ... H01R 13/648; H01R 13/42; H01R 13/6471

USPC ..... 439/607.05, 607.07, 607.11, 607.23

See application file for complete search history.

(56) References Cited

U.S. PATENT DOCUMENTS

| | | | | |
|---|---|---|---|---|
| 2,049,560 | A * | 8/1936 | Ezzo | H01R 13/055 439/695 |
| 3,192,498 | A * | 6/1965 | Ruehlemann | H01R 13/111 439/223 |
| 4,778,231 | A * | 10/1988 | Seidler | H01R 13/193 439/295 |
| 7,819,697 | B2 * | 10/2010 | Glover | H01R 13/514 439/607.07 |
| 8,287,322 | B2 | 10/2012 | Jeon | |
| 8,512,081 | B2 | 8/2013 | Stokoe | |
| 8,550,861 | B2 | 10/2013 | Cohen et al. | |

(Continued)

FOREIGN PATENT DOCUMENTS

CN 202019074 U 10/2011

*Primary Examiner* — Abdullah A Riyami
*Assistant Examiner* — Thang H Nguyen

(57) ABSTRACT

Electrical contact includes a base portion and a mating portion having a leading end of the electrical contact. The mating portion includes a contact finger coupled to the base portion and extends between the base portion and the leading end. The contact finger has an engagement surface that is shaped to define a primary contact zone. The electrical contact also includes a resonance-control protrusion shaped to define a stub-contact zone. The stub-contact zone is positioned at the base portion or between the base portion and the primary contact zone. The primary contact zone and the stub-contact zone are configured to engage another contact. The stub-contact zone is configured to impede electrical resonance along a stub portion of the other contact.

19 Claims, 6 Drawing Sheets

(56) References Cited

U.S. PATENT DOCUMENTS

| | | | | |
|---|---|---|---|---|
| 8,727,791 | B2 * | 5/2014 | Gulla | H01R 12/91 439/65 |
| 8,814,595 | B2 * | 8/2014 | Cohen | H01R 13/6461 439/607.07 |
| 9,077,094 | B2 * | 7/2015 | Minich | H01R 13/42 |
| 2009/0239395 | A1 * | 9/2009 | Cohen | H01R 12/727 439/65 |

* cited by examiner

ELECTRICAL CONNECTOR AND ELECTRICAL CONTACT CONFIGURED TO REDUCE RESONANCE

BACKGROUND

The subject matter herein relates generally to electrical contacts having stub portions that generate an electrical resonance during operation.

Electrical connectors are used to transmit data in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as a wiping action, because each receptacle contact wipes along a contact surface of the corresponding header contact.

During this wiping action, each receptacle contact typically slides from a contact end of the corresponding header contact toward a mating zone along the header contact. The mating zone is a distance away from the contact end of the header contact. The portion of the header contact that extends between the contact end and the mating zone is referred to as a stub portion. During operation of the system, energy propagates from the mating zone to the contact end of the header contact where the energy is then reflected back toward the mating zone. At current transmission speeds the reflected energy may resonate, such that the stub portion acts as an antenna that enables electromagnetic radiation to permeate the interface between the mated header and receptacle contacts. Shielding may be required to contain such electromagnetic interference (EMI) radiated by stub portions acting as antennas, which may be costly and thereby increase the cost of manufacturing the connectors.

Accordingly, a need remains for electrical contacts that reduce the unwanted effects of reflected energy along stub portions of the electrical contacts.

BRIEF DESCRIPTION

In an embodiment, an electrical contact is provided that includes a base portion and a mating portion having a leading end of the electrical contact. The mating portion includes a contact finger coupled to the base portion and extends between the base portion and the leading end. The contact finger has an engagement surface that is shaped to define a primary contact zone. The electrical contact also includes a resonance-control protrusion shaped to define a stub-contact zone. The stub-contact zone is positioned at the base portion or between the base portion and the primary contact zone. The primary contact zone and stub-contact zone are configured to engage another contact. The stub-contact zone is configured to impede electrical resonance along a stub portion of the other contact.

Embodiments may simultaneously engage the other contact at the primary contact zone and the stub-contact zone.

For embodiments communicating signals (e.g., data signals), the stub-contact zone may be configured to impede electrical resonance along a stub portion of the other contact.

In some aspects, the contact finger is deflected by the other contact during a mating operation in which the primary contact zone wipes along a surface of the other contact. The primary contact zone and the stub-contact zone face in a common direction. Optionally, the contact finger is configured to have a deflected state as the primary contact zone engages the other contact and wipes along the surface of the other contact. The stub-contact zone is configured to engage the surface of the other contact while the contact finger is in the deflected state.

In some aspects, the contact finger is stamped-and-formed from sheet material. The resonance-control protrusion is an embossed region of the sheet material.

In some aspects, the contact finger has a width extending between two edge segments. The resonance-control protrusion has a width that is less than the width of the contact finger. Optionally, the resonance-control protrusion includes one of the edge segments of the contact finger.

In some aspects, the contact finger is a first contact finger and the mating portion includes a second contact finger. The second contact finger is coupled to the base portion and extends between the base portion and the leading end. The second contact finger has a corresponding engagement surface that is shaped to define a corresponding contact zone. The first and second contact fingers oppose each other with a contact-receiving space therebetween.

Optionally, the first contact finger has a contoured end segment that extends between the primary contact zone and the leading end of the electrical contact. The second contact finger has a contoured end segment that extends between the contact zone of the second contact finger and the leading end of the electrical contact. The contoured end segment of the first contact finger is longer than the contoured end segment of the second contact finger.

In some aspects, the contact finger includes the resonance-control protrusion such that the resonance-control protrusion is positioned between the base portion and the primary contact zone and moves relative to the base portion when the contact finger is deflected.

In an embodiment, an electrical connector is provided that includes a connector housing configured to engage another connector. The electrical connector also includes a plurality of electrical contacts coupled to the connector housing. Each of the electrical contacts of the plurality of electrical contacts includes a base portion and a mating portion having a leading end of the electrical contact. The mating portion includes a contact finger coupled to the base portion and extends between the base portion and the leading end. The contact finger has an engagement surface that is shaped to define a primary contact zone. Each of the electrical contacts of the plurality also includes a resonance-control protrusion shaped to define a stub-contact zone. The stub-contact zone is positioned at the base portion or between the base portion and the primary contact zone. The primary contact zone and the stub-contact zone are configured to simultaneously engage another contact. The stub-contact zone is configured to impede electrical resonance along a stub portion of the other contact.

In some aspects, the contact finger is deflected by the other contact during a mating operation in which the primary contact zone wipes along a surface of the other contact. The contact finger is configured to have a deflected state as the primary contact zone engages the other contact and wipes along the surface of the other contact. The stub-contact zone is configured to engage the surface of the other contact while the contact finger is in the deflected state.

In some aspects, the contact finger has a contoured end segment that extends between the primary contact zone and the leading end of the electrical contact. The connector housing has an interior surface. The contoured end segment is configured to engage the interior surface of the connector housing as the contact finger is deflected by the other contact during a mating operation. The interior surface blocks movement of the contoured end segment while permitting the contact finger to bow when the stub-contact zone engages the other contact.

In some aspects, the contact finger is stamped-and-formed from sheet material. The resonance-control protrusion is an embossed region of the sheet material.

In some aspects, the contact finger has a width extending between two edge segments. The resonance-control protrusion has a width that is less than the width of the contact finger.

In some aspects, the contact finger is a first contact finger and the mating portion of each of the electrical contacts includes a second contact finger. The second contact finger is coupled to the base portion and extends between the base portion and the leading end. The second contact finger has a corresponding engagement surface that is shaped to define a corresponding contact zone. The first and second contact fingers oppose each other with a contact-receiving space therebetween.

Optionally, the first contact finger has a contoured end segment that extends between the primary contact zone and the leading end of the electrical contact. The second contact finger has a contoured end segment that extends between the contact zone of the second contact finger and the leading end of the electrical contact. The contoured end segment of the first contact finger is sized and shaped differently than the contoured end segment of the second contact finger. The contoured end segment of the second contact finger and the interior surface are shaped relative to one another such that a flex gap exists between the contoured end segment of the second contact finger and the interior surface of the connector housing. The second contact finger is permitted to move during the mating operation.

In an embodiment, a communication system is provided that includes a mating connector having a mating contact and an electrical connector having a connector housing and a plurality of electrical contacts coupled to the connector housing. Each of the electrical contacts of the plurality of electrical contacts includes a base portion and a mating portion having a leading end of the electrical contact. The mating portion includes a contact finger coupled to the base portion and extends between the base portion and the leading end. The contact finger has an engagement surface that is shaped to define a primary contact zone. Each of the electrical contacts of the plurality also includes a resonance-control protrusion shaped to define a stub-contact zone. The stub-contact zone is positioned at the base portion or between the base portion and the primary contact zone. The primary contact zone and the stub-contact zone are configured to simultaneously engage the mating contact of the mating connector. The stub-contact zone is configured to impede electrical resonance along a stub portion of the mating contact.

In some aspects, the contact finger is deflected by the other contact during a mating operation in which the primary contact zone wipes along a surface of the other contact. The contact finger is configured to have a deflected state as the primary contact zone engages the other contact and wipes along the surface of the other contact. The stub-contact zone is configured to engage the surface of the other contact while the contact finger is in the deflected state.

In some aspects, the contact finger has a contoured end segment that extends between the primary contact zone and the leading end of the electrical contact. The connector housing has an interior surface. The contoured end segment is configured to engage the interior surface of the connector housing as the contact finger is deflected by the other contact during a mating operation. The interior surface blocks movement of the contoured end segment while permitting the contact finger to bow when the stub-contact zone engages the other contact.

In some aspects, the contact finger is stamped-and-formed from sheet material. The resonance-control protrusion is an embossed region of the sheet material.

DETAILED DESCRIPTION

Figure 1:
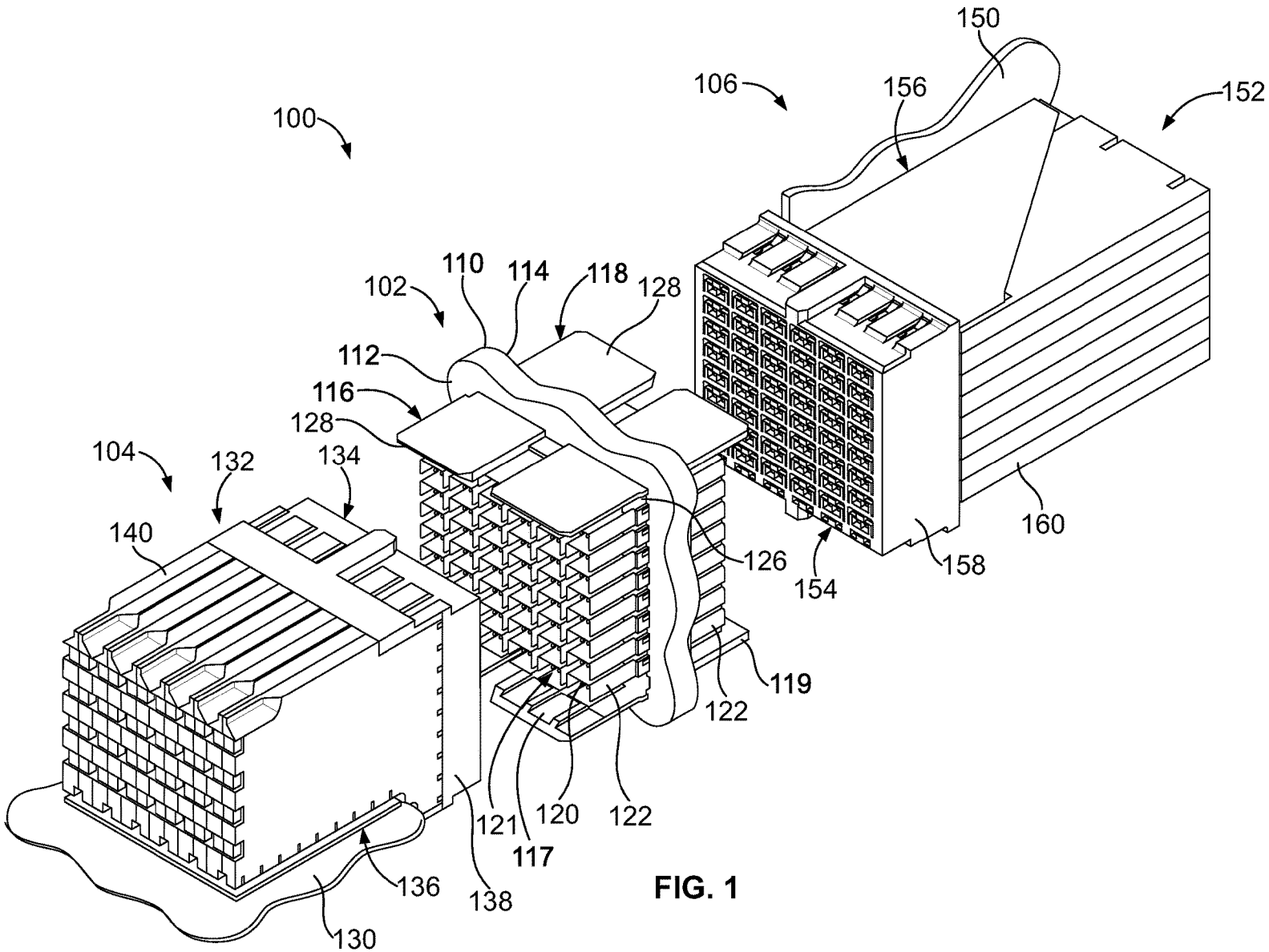
FIG. 1 is a front perspective view of a communication system formed in accordance with an embodiment.

Embodiments set forth herein may include electrical contacts, electrical connectors having the electrical contacts, connectors assemblies including the electrical connectors, and communication systems having the electrical connectors, among other things. Embodiments may be configured to improve electrical performance by, for example, damping or impeding electrical resonance that may occur in stub portions of electrical contacts. More specifically, electrical contacts may include a resonance-control protrusion that forms a second contact zone where the electrical contact engages another contact.

The electrical contacts may form signal paths in which data signals are transmitted through the electrical contacts. Alternatively, the electrical contacts may form ground conductors in which each ground conductor shields adjacent signal paths from one another and provides a return path. Each electrical contact is configured to be engaged by another contact at a contact zone. The contact zone is located a distance away from an end of the electrical contact thereby forming the stub portion. More specifically, the stub portion is the portion of the electrical contact in which energy resonates between the end of the electrical contact and the contact zone.

In some embodiments, the electrical connectors are configured to mate with other electrical connectors during a mating operation. During the mating operation, a first electrical contact of one connector may engage and slide (or wipe) along a second electrical contact of the other connector. The second electrical contact may include, among other things, a wipe runway. The first electrical contact slides along the wipe runway of the second electrical contact and operably engages the second electrical contact at the contact zone.

Although the illustrated embodiment includes electrical connectors that are used in high-speed communication systems, such as, but not limited to, backplane or midplane communication systems, it should be understood that embodiments may be used in other communication systems and/or in other systems/devices that utilize electrical contacts having stub portions. It should also be understood that embodiments do not require a wiping action between two electrical contacts. Accordingly, the inventive subject matter is not limited to the illustrated embodiment.

In particular embodiments, the electrical contacts provide signal pathways for transmitting data signals. Embodiments may be particularly suitable for communication systems, such as, but not limited to, network systems, servers, data centers, and/or the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 $mm^2$ along the mating side or the mounting side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

Electrical contacts described herein may include a plurality of different materials. For example, an electrical contact may include a base material, such as, but not limited to, copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

Different materials of an electrical contact may be selected to impede electrical resonance along any stub portions. For example, one or more of the materials used in the electrical contacts may be ferromagnetic. More specifically, one or more materials may have a higher relative magnetic permeability. In particular embodiments, the electrical contact includes a material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, alloys of the same, and/or the like. In some embodiments, the material is a martensitic stainless steel (annealed). Materials that have a higher permeability provide a higher internal self-inductance. High permeability may also cause shallow skin depths, which may increase the effective resistance of the electrical contact within a predetermined frequency band.

As used herein, phrases such as "a plurality of [elements]" and "an array of [elements]" and/or the like, when used in the detailed description and claims, do not necessarily include each and every element that a component may have. The component may have other elements that are similar to the plurality of elements. For example, the phrase "a plurality of electrical contacts [being/having a recited feature]" does not necessarily mean that each and every electrical contact of the component has the recited feature. Other electrical contacts may not include the recited feature. Accordingly, unless explicitly stated otherwise (e.g., "each and every electrical contact of the electrical connector [being/having a recited feature]"), embodiments may include similar elements that do not have the recited features.

In order to distinguish similar elements in the detailed description and claims, various labels may be used. For example, an electrical connector may be referred to as a header connector, a receptacle connector, and/or a mating connector. Electrical contacts may be referred to as header contacts, receptacle contacts, and/or mating contacts. When similar elements are labeled differently (e.g., receptacle contacts and mating contacts), the different labels do not necessarily require structural differences.

Embodiments set forth herein are described with respect a backplane or midplane communication system having a central printed circuit board (PCB). Header connectors are mounted to each side of the PCB. The header connectors include electrical contacts, such as the electrical contacts described herein. Conductive pathways extend through the PCB via plated thru-holes (PTHs) and conductive traces. The conductive pathways electrical connect different electrical contacts of the header connectors. Receptacle daughtercards are mated to the header connectors on both sides of the PCB.

Yet alternative configurations of such communication systems exist. In one configuration, the header connectors are mounted to only one side of the PCB and receptacle daughtercards are mated to the same side. In another configuration (referred to as a direct plug orthogonal (DPO)

configuration), a central PCB does not exist. The central PCB may be referred to as a backplane or mid-plane circuit board. Mezzanine (parallel) PCB configurations are also contemplated. Accordingly, it should be understood that the electrical contacts set forth herein may be used in a number of different applications.

FIG. 1 is a perspective view of a communication system 100 formed in accordance with an embodiment. The communication system 100 is an electrical connector system. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, either of the first and second connector systems 104, 106 may be part of a line card assembly or a switch card assembly. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as, but not limited to, a plastic material. Each of the connector housings 117, 119 includes a mounting wall 126 that is configured to be mounted to the circuit board 110, and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

Figure 3:
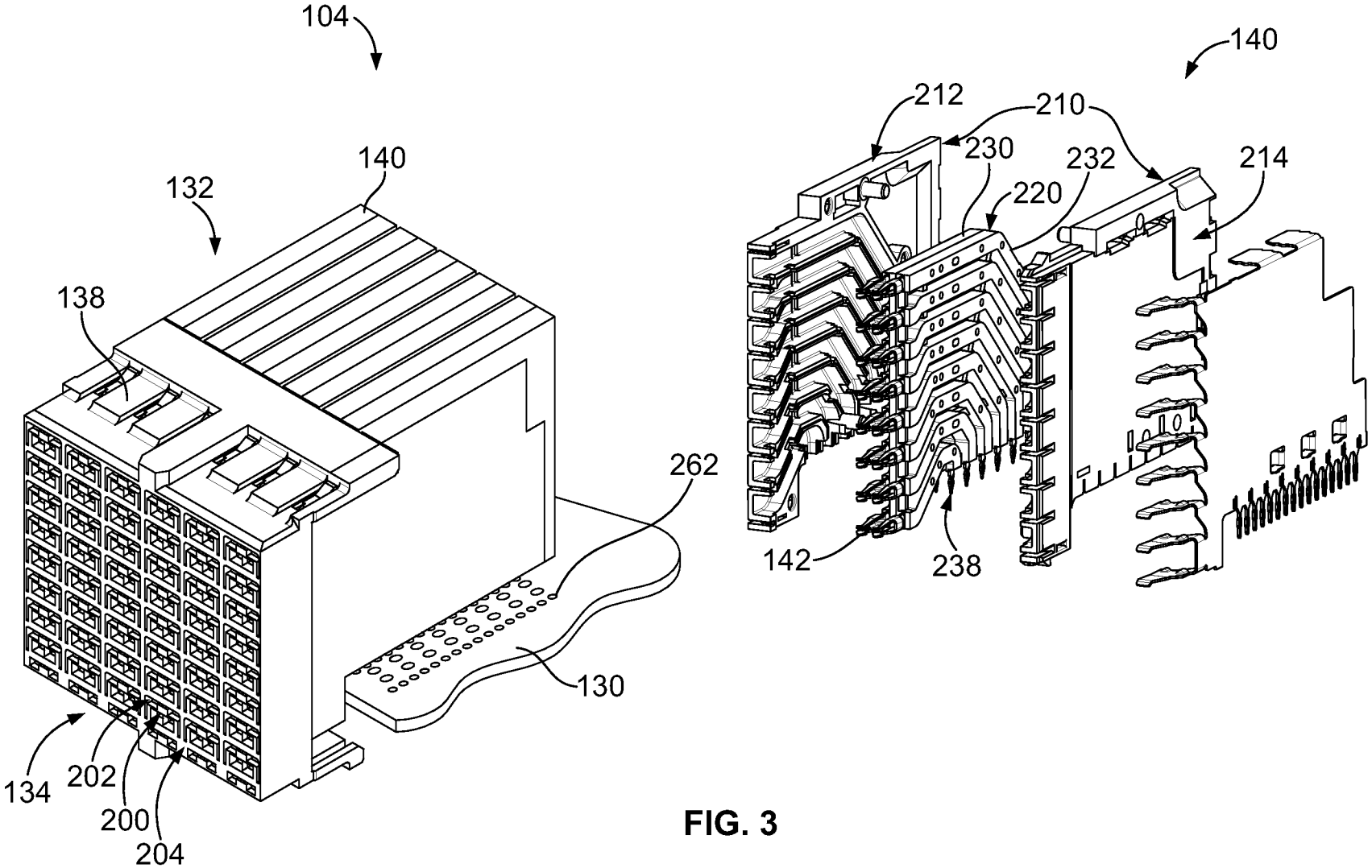
FIG. 3 is a perspective view of a receptacle connector that may be used with the communication system of FIG. 1.
Figure 4:
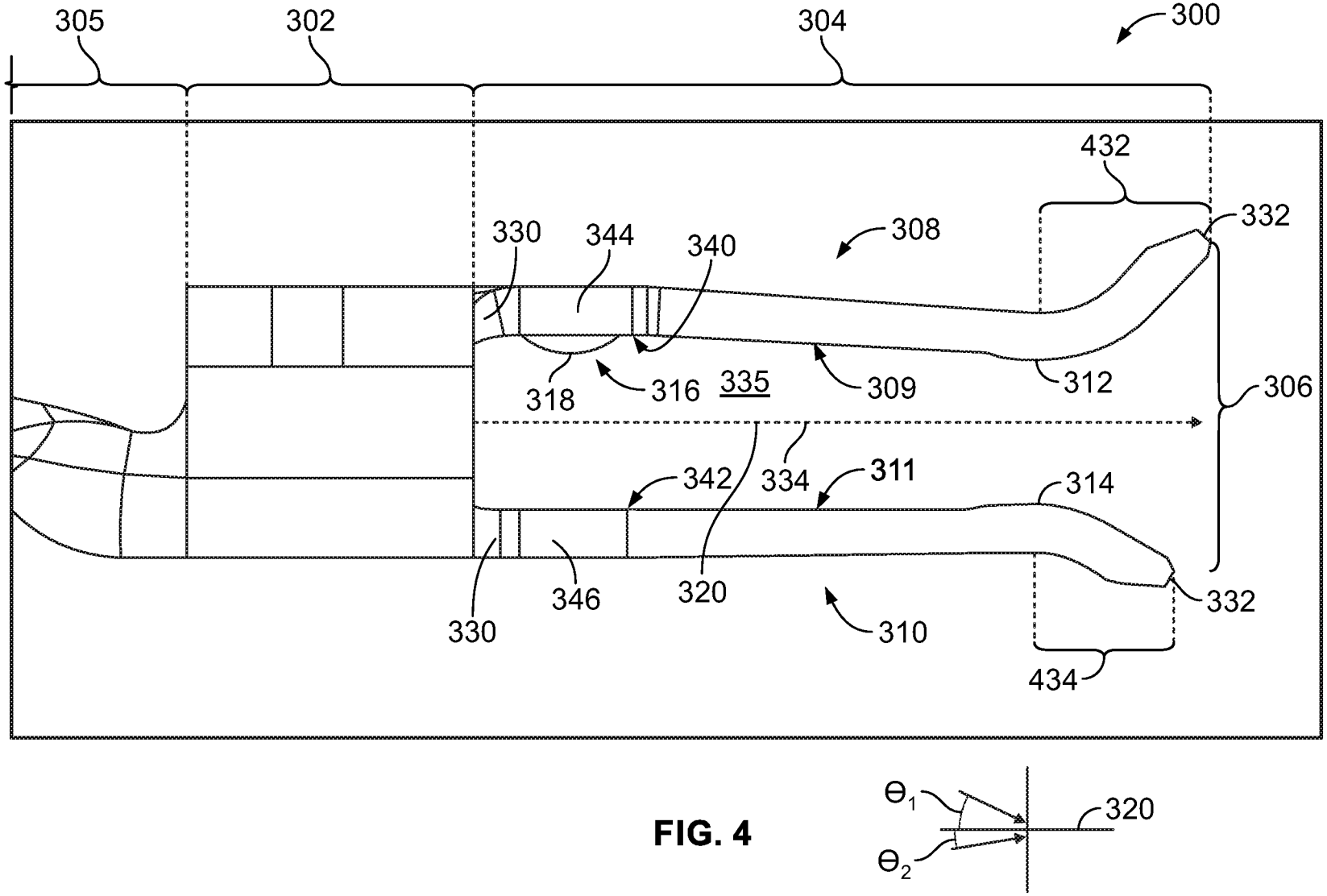
FIG. 4 is a side view of an electrical contact formed in accordance with an embodiment.

The first receptacle connector 132 includes a connector housing 138. The connector housing 138 may be referred to as a front housing or shroud in some embodiments. The connector housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (FIG. 3) that are electrically connected to the first circuit board 130. The electrical contacts 142 are hereinafter referred to as receptacle contacts 142. The receptacle contacts 142 are configured to be electrically connected to the header contacts 120 of the first header connector 116. The electrical contacts 142 may be similar or identical to electrical contacts 300 (FIG. 4). The electrical contacts 142 may form a contact array that is configured to mate with the contact array 168.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Similar to the first receptacle connector 132, the second receptacle connector 152 includes a connector housing 158 used to hold a plurality of contact modules 160. The connector housing 158 may be referred to as a front housing or shroud in some embodiments. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
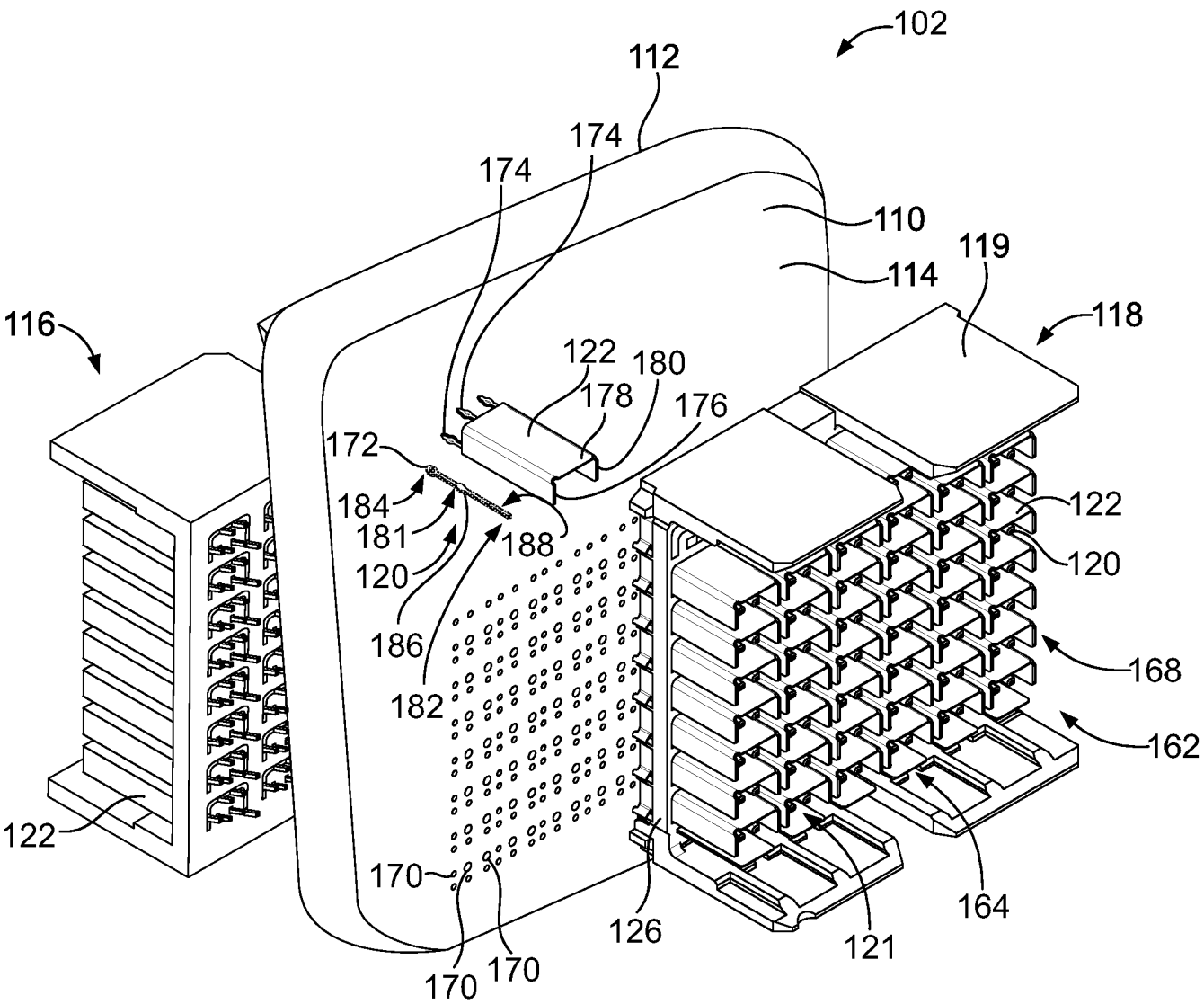
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a contact end 162 that faces away from the second board side 114 of the circuit board 110. The connector housing 119 defines a housing cavity 164 that opens to the contact end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, specifically three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

The header contact 120 includes a contact end 182 and a back end 184. A conductive pathway exists between the contact and back ends 182, 184. The back end 184 is configured to engage the circuit board 110. The contact end 182 may represent the portion of the header contact 120 that is located furthest from the circuit board 110 or the mounting wall 126 and is the first to engage or interface with the second receptacle connector 152 (FIG. 1). As such, the contact end 182 may also be referred to as the leading end or the mating end.

The header contact 120 also includes a contact body 181. The header contact 120 (or the contact body 181) includes a plurality of segments that are shaped differently from one another and may have different functions. For example, the header contact 120 includes the compliant pin 172, a base segment 186, and a mating segment 188. The compliant pin 172 includes the back end 184, and the mating segment 188 includes the contact end 182. As described above, the compliant pin 172 mechanically engages and electrically couples to a corresponding conductive via 170 of the circuit board 110.

The base segment 186 is sized and shaped to directly engage the mounting wall 126 of the connector housing 119. For example, the base segment 186 may be inserted into a passage (not shown) of the mounting wall 126 and engage the mounting wall 126 to form an interference fit therewith.

The mating segment 188 may represent the portion of the header contact 120 that is exposed within the housing cavity 164. As described below, the mating segment 188 (or a portion thereof) is configured to slidably engage a corresponding receptacle contact 142 (FIG. 3) during the mating operation.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The connector housing 138 includes a plurality of contact openings 200, 202 at a contact end 204 of the connector housing 138. The contact end 204 defines the mating interface 134 of the first receptacle connector 132 that engages the first header connector 116 (FIG. 1).

The contact modules 140 are coupled to the connector housing 138 such that the receptacle contacts 142 are received in corresponding contact openings 200. Optionally, a single receptacle contact 142 may be received in each contact opening 200. The contact openings 200 receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The connector housing 138 may be manufactured from a dielectric material, such as, but not limited to, a plastic material, and may provide isolation between the contact openings 200 and the contact openings 202. The connector housing 138 may isolate the receptacle contacts 142 and the header contacts 120 from the ground shields 122. In some embodiments, the contact module 140 includes a conductive holder 210. The conductive holder 210 may include a first holder member 212 and a second holder member 214 that are coupled together. The holder members 212, 214 may be fabricated from a conductive material. As such, the holder members 212, 214 may provide electrical shielding for the first receptacle connector 132. When the holder members 212, 214 are coupled together, the holder members 212, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through a corresponding signal conductor (not shown).

FIG. 4 is a side view of a portion of an electrical contact 300 in accordance with an embodiment. The electrical contact 300 may be coupled directly or indirectly to a connector housing of an electrical connector, such as the electrical connector 132 (FIG. 3). The electrical contact 300 includes a base portion 302 and a mating portion 304 that is coupled to the base portion 302. Optionally, the electrical contact 300 may include a terminal portion 305. The base portion 302 extends between the mating portion 304 and the terminal portion 305.

In particular embodiments, the electrical contact 300 is a receptacle contact and may be used as the receptacle contact 142 (FIG. 3). The base portion 302 has a trailing end (not shown) and may be configured to terminate or couple to a longer conductor, such as, but not limited to, conductors found in lead frames (e.g., the signal conductors of the contact modules 140 shown in FIG. 3). In other embodiments, the electrical contact 300 may be a conductor that is configured to engage a circuit board.

The mating portion 304 is configured to engage another contact, such as the contact 446 (FIG. 6), to establish an electrical connection between the electrical contact 300 and the other contact. The mating portion 304 includes a leading end 306 of the electrical contact 300. The mating portion 304 also includes at least one contact finger. For example, the mating portion 304 in FIG. 4 includes a first contact finger 308 and a second contact finger 310. The first and second contact fingers 308, 310 are coupled to the base portion 302. Each of the first and second contact fingers 308, 310 extend lengthwise between the base portion 302 and the leading end 306. Each of the first and second contact fingers 308, 310 has a joint 330 that directly connects to the base portion 302. Each of the first and second contact fingers 308, 310 has a distal tip 332. The first and second contact fingers 308, 310 extend lengthwise between the respective joint 330 and the respective distal tip 332. Each of the distal tips 332 forms a part of the leading end 306.

In the illustrated embodiment, the contact fingers 308, 310 are spring contacts that are configured to be resiliently deflected when engaged with the other contact. More specifically, the contact fingers 308, 310 are configured to flex about the respective joint 330 and relative to the base portion 302. As described herein, the contact fingers 308, 310 may also bow or bend.

The first and second contact fingers 308, 310 have respective engagement surfaces 309, 311. A contact-receiving space 335 exists between the engagement surfaces 309, 311 and represents a space that will receive the other contact. The engagement surface 309 is shaped to define a primary contact zone 312 of the first contact finger 308, and the engagement surface 311 is shaped to define a primary contact zone 314 of the second contact finger 310. The electrical contact 300 also includes at least one resonance-control protrusion 316 that is shaped to define a stub-contact zone 318. In the illustrated embodiment, the stub-contact zone 318 is positioned between the base portion 302 and the primary contact zone 314. Optionally, the stub-contact zone 318 may be positioned on the base portion 302.

In the illustrated embodiment, the resonance-control protrusion 316 is part of the first contact finger 308. The resonance-control protrusion 316 may form a topological deviation (e.g., abrupt change in elevation) along the engagement surface 309. In other embodiments, the resonance-control protrusion may be part of the base portion 302. For example, the resonance-control protrusion may be positioned at the base portion 302 proximate to or directly connected to the first contact finger 308. The resonance-control protrusion may also extend along the joint 330.

The primary contact zone 312 and the stub-contact zone 318 of the first contact finger 308 and the primary contact zone 314 of the second contact finger 310 are localized areas where the respective engagement surface intimately engages the other contact to form an electrical connection therebetween. The primary contact zone 312 and the stub-contact zone 318 of the first contact finger 308 are configured to engage the other contact during operation of the electrical connector. In the illustrated embodiment, the primary contact zone 312 and the stub-contact zone 318 face in a common direction. As described herein, the stub-contact zone 318 is configured to impede electrical resonance along a stub portion of the other contact during operation.

In FIG. 4, the electrical contact 300 is oriented with respect to a central longitudinal axis 320 that extends therethrough between the trailing end and the leading end 306. The central longitudinal axis 320 extends through a geometric center of a cross-sectional profile of the electrical contact 300. In the illustrated embodiment, the central longitudinal axis 320 appears to be a straight line. In other embodiments, however, the central longitudinal axis 320 may bend as the shape of the electrical contact 300 changes along a length of the electrical contact 300.

The electrical contact 300 in FIG. 4 has an undeflected condition in which the contact fingers 308, 310 are not experiencing forces. The contact fingers 308, 310 are in resting positions. In the resting positions of the illustrated embodiment, the contact fingers 308, 310 extend partially toward the longitudinal axis 320. More specifically, a central plane 334 coincides with the longitudinal axis 320 and divides the contact-receiving space 335. The first contact finger 308 extends partially toward the central plane 334 such that a convergence angle $\Theta_1$ is formed. The contact finger 310 extends partially toward the central plane 334 such that a convergence angle $\Theta_2$ is formed. In the illustrated embodiment, the convergence angle $\Theta_1$ is greater than the convergence angle $\Theta_2$ such that the first contact finger 308 approaches the central plane 334 at a greater rate.

The convergence angles may be measured from a point along the engagement surface at which the convergence of the contact finger begins and the primary contact zone of the contact finger. For example, the convergence angle $\Theta_1$ is measured from a point 340 along the engagement surface 309 to the primary contact zone 312 of the first contact finger 308. The convergence angle $\Theta_2$ is measured from a point 342 along the engagement surface 311 to the primary contact zone 314 of the contact finger 310. In some embodiments, the first contact finger 308 may provide a greater resistance to being deflected than the contact finger 310.

The portion of the first contact finger 308 that extends from the joint 330 to the point 340 may be referred to as a platform portion 344. The platform portion 344 includes the resonance-control protrusion 316. The portion of the contact finger 310 that extends from the joint 330 to the point 342 may be referred to as a platform portion 346. As shown, the engagement surfaces 309, 311 along the platform portions 344, 346, respectively, extend essentially parallel to the central plane 334.

Also shown in FIG. 4, the first contact finger 308 has a contoured end segment 432 that extends between the primary contact zone 312 and the distal tip 332 (or the leading end 306) of the electrical contact 300. The second contact finger 310 has a contoured end segment 434 that extends between the contact zone 314 of the second contact finger 310 and the distal tip 332 (or the leading end 306) of the electrical contact 300. In FIG. 4, the contoured end segment 432 of the first contact finger 308 is longer than the contoured end segment 434 of the second contact finger 310. The contoured end segment 432 may be sized and shaped relative to the connector housing 440 (shown in FIG. 6) such that the contoured end segment 432 engages the connector housing 440 during the mating operation. The connector housing 440 may block movement of the contoured end segment 432 while permitting the first contact finger 308 to bow when the stub-contact zone 318 engages the other contact.

In other embodiments, however, the connector housing 440 may be sized and shaped to engage the contoured end segment 432 of the first contact finger 308. As such, the contoured end segment 432 may be equal in length to the contoured end segment 434 of the second contact finger 310. Yet in other embodiments, the contoured end segment 432 of the first contact finger 308 may be wider than the contoured end segment 434 of the second contact finger 310. Accordingly, the contoured end segments 432, 434 may have the same size and shape or may have different sizes and/or shapes.

Figure 5:
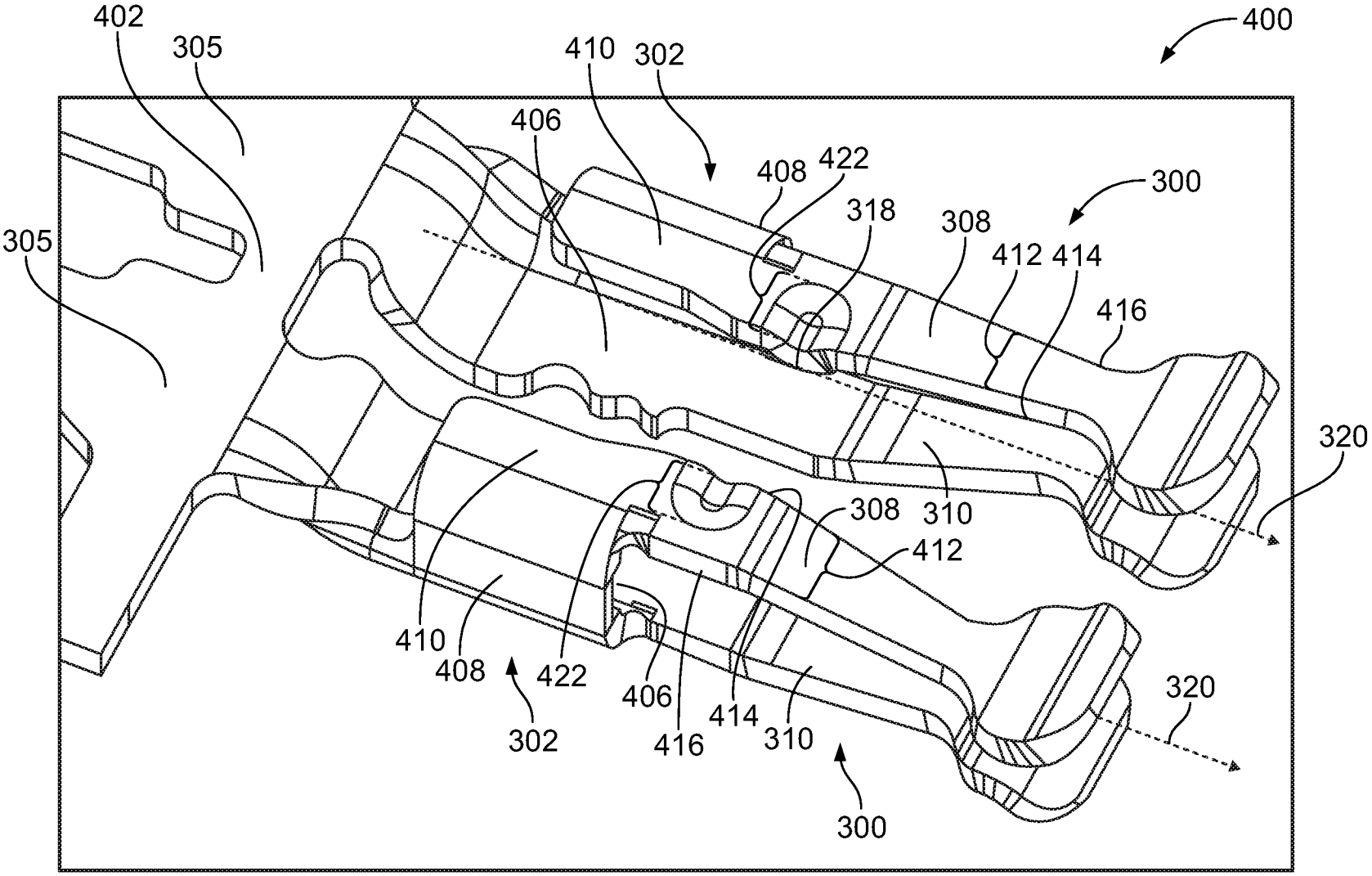
FIG. 5 is a perspective view of a carrier strip formed in accordance with an embodiment that includes the electrical contact of FIG. 4.

FIG. 5 is a perspective view of a carrier strip or frame 400 that includes a pair of electrical contacts 300. The electrical contact 300 may be stamped from a sheet of material, thereby forming the carrier strip 400, and subsequently shaped to include the features described herein. For example, the electrical contact 300 may be stamped-and-formed from sheet material (e.g., sheet metal). The sheet material may be shaped (e.g., deformed) to provide the resonance-control protrusion 316 and other features of the electrical contact 300. The resonance-control protrusion 316 may be an embossed region of the sheet material. However, it should be understood that other processes may be used in manufacturing the electrical contact 300.

As shown, the terminal portions 305 of the electrical contacts 300 are connected to one another through a bridge 402. The carrier strip 400 holds the electrical contacts 300 with respect to one another during manufacturing. At some time during manufacturing, the electrical contacts 300 are separated from one another. For example, the bridge 402 that joins the terminal portions 305 of the electrical contacts 300 may be removed by, for instance, etching or stamping. Subsequently, the terminal portions 305 may be connected to a conductor of the corresponding electrical connector.

The base portion 302 of each of the electrical contacts 300 has a C-shaped (or U-shaped) structure that extends about the longitudinal axis 320. The C-shape or U-shape may be rounded or have sharp edges. The base portion 302 includes a proximal support section 406, an intermediate section 408, and a distal support section 410. The intermediate section 408 extends between and joins the proximal and distal support sections 406, 410. The distal support section 410 supports the first contact finger 308. The proximal support section 406 supports the second contact finger 310 and is directly connected to the terminal portion 305. When the first and second contact fingers 308, 310 are deflected, the distal and proximal supports sections 410, 406, respectively, are held in an essentially fixed positions. As such, the first and second contact fingers 308, 310 move relative to the distal and proximal supports sections 410, 406, respectively, during a mating operation.

Also shown in FIG. 5, each of the first contact fingers 308 has a width 412 that extends between (or is measured between) two edge segments 414, 416. The resonance-control protrusion 316 includes the edge segment 414 and not the edge segment 416, but the resonance-control protrusion 316 may include only the edge segment 416 in other embodiments. Yet in alternative embodiments, the resonance-control protrusion 316 may include each of the edge segments 414, 416 or may not include either of the edge segments 414, 416.

FIG. 5 illustrate dimensions of the resonance-control protrusion 316 relative to the remainder of the electrical contact 300. The resonance-control protrusion 316 has a width 422 (FIG. 5) and a length 424 (shown in FIG. 6). The resonance-control protrusion 316 is defined as a portion of the engagement surface 309 that abruptly changes elevation relative to the surrounding engagement surface 309. In the illustrated embodiment, the engagement surface 309 is devoid of abrupt changes in elevation from the resonance-control protrusion 316 to the primary contact zone 312. The length 424 of the resonance-control protrusion 316 is measured along the longitudinal axis 320. The width 422 is measured transverse to the length 424. In particular embodiments, the width 422 of the resonance-control protrusion 316 is less than the width 412 of the first contact finger 308 where the resonance-control protrusion 316 is located. In particular embodiments, a ratio of the length 424 and the width 422 is between 2:1 and 1:2.

Figure 6:
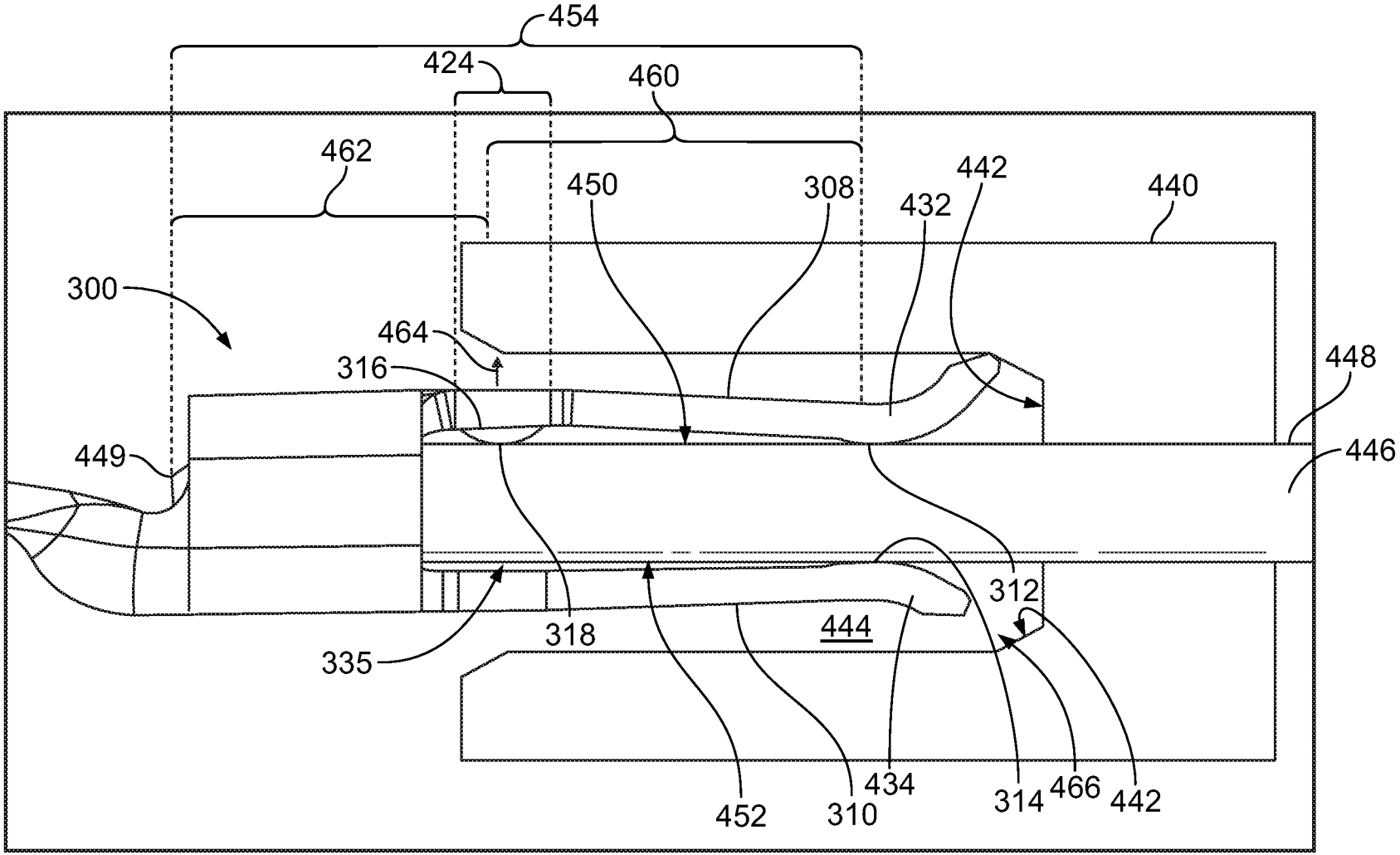
FIG. 6 is a side view of the electrical contact in an operating position within a loading space of a connector housing.

FIG. 6 is a side view of the electrical contact 300 in an operating position. In such embodiments, the electrical contacts 300, 446 are configured to communicate data signals therebetween. It should be understood, however, that the electrical contact 300 and the electrical contact 446, which may be referred to herein as the "other contact" or "the contact," may have different configurations and/or be used in other applications. It should also be understood that the electrical contact 300 and the electrical contact 446 may be ground conductors in alternative embodiments. In such embodiments, the ground conductors may shield adjacent signal conductors (or signal pairs) from one another and/or provide a return path.

A portion of the connector housing 440 is shown in FIG. 6. The connector housing 440 may be similar or identical to the connector housings 138, 158 (FIG. 1). The connector housing 440 has an interior surface 442 that defines a loading space 444. The loading space 444 is sized and shaped to receive the electrical contact 300 and, after the mating operation, the other contact 446.

The contact 446 includes an elongated contact body 448 that extends from a base (not shown) to a distal tip 449. The contact body 448 has an exterior surface that includes first and second runways 450, 452. The first runway 450 is configured to slidably engage the first contact finger 308, and the second runway 452 is configured to slidably engage the second contact finger 310. In the operating position shown in FIG. 6, the primary contact zone 312 of the first contact finger 308 is engaged to the first runway 450. The primary contact zone 314 of the second contact finger 310 is engaged to the second runway 452.

Also shown, the stub-contact zone 318 of the resonance-control protraction 316 is also engaged to the first runway 450. Accordingly, the first contact finger 308 engages the contact 446 at two separate points. Specifically, the points at which the primary contact zone 312 and the stub-contact zone 318 engage the first runway 450. A portion of the contact 446 extending between the point at which the primary contact zone 312 engages the first runway 450 and the distal tip 449 may represent a stub portion 454 of the contact 446. The stub portion 454 has an electrical length, which is a length of a path taken by current from about the primary contact zone 312 to the distal tip 449 (or the end of the stub portion 454).

During operation, energy reflects back-and-forth between the distal tip 449 and the primary contact zone 312 and causes a standing wave and electrical resonance. The electrical resonance is a function of the electrical length. The stub-contact zone 318 effectively reduces the electrical length, thereby changing the electrical resonance. The stub-contact zone 318 may be separated from the primary contact zone 312 by a portion of the electrical length. This portion is referred to herein as a first separation distance 460. The stub-contact zone 318 may be separated from the distal tip 449 by another portion of the electrical length. This portion is referred to herein as a second separation distance 462. The first and second separation distances 460, 462 may be increased or decreased to change performance. More specifically, the stub-contact zone 318 may be configured to impede electrical resonance along the stub portion 454 of the contact 446 while communicating signals therethrough.

In some instances, the resonance-control protrusion 316 may inadvertently cause the primary contact zone 312 to separate from the first runway 450. To reduce the likelihood of this occurring, the interior surface 442 of the connector housing 440 and the electrical contact 300 are shaped relative to each other such that the interior surface 442 engages the contact finger 308 and prevents the contact finger 308 and the contact 446 from separating at the primary contact zone 312.

Accordingly, as the contact 446 is inserted into the contact-receiving space 335, the primary contact zones 312, 314 engage the first and second runways 450, 452, respectively, thereby deflecting the first and second contact fingers 308, 310, respectively. During the mating operation or prior to the mating operation, the contoured end segment 432 may engage the interior surface 442 of the connector housing 440. As such, the interior surface 442 may block movement of the contact finger 308. As the contact 446 continues to move into the contact-receiving space 335, the primary contact zones 312, 314 slide (or wipe) along the first and second runways 450, 452, respectively. At some point, the contact 446 engages the stub-contact zone 318 of the contact finger 308 thereby causing a force (indicated by arrow 464) that deflects the contact finger 308 at the resonance-control protrusion 316. Because the contoured end segment 432 is blocked by the connector housing 440, the portion of the first contact finger 308 between the primary contact zone 312 and the stub-contact zone 318 may move away from the contact 446. More specifically, the interior surface 442 of the connector housing 440 may block movement of the contoured end segment 432 away from the first runway 450 while permitting the first contact finger 308 to bow when the stub-contact zone 318 engages the other contact 446. Accordingly, embodiments provide a mechanism for controlling or reducing the electrical length of the stub portion while also allowing a wipe distance that is within tolerances.

In some embodiments, the contoured end segment 434 of the second contact finger 310 is separated from the interior surface 442 of the connector housing 440 by a flex gap 466. The flex gap 466 permits movement of the second contact finger 310 during the mating operation. Permitting the second contact finger 310 to move may reduce the mating force necessary for mating the other contact 446 with the electrical contact 300. For example, the first contact finger 308 may be blocked from moving by the connector housing 440. Unlike other electrical contacts, the electrical contact 300 engages the other contact 446 at two separates points (e.g., the primary contact zone 312 and the stub-contact zone 318). The frictional forces generated by the first contact finger 308 and the first runway 450 of the other contact 446 may be greater when the first contact finger 308 is not permitted to be deflected further away. In such instances, the flex gap 466 (and compliance of the second contact finger 310) may enable a mating operation that requires less force.

In some cases, tolerances of the other contact 446 and/or the connector housing that is coupled to the other contact 446 may permit at least some deflection by the other contact 446 toward the second contact finger 310. The flex gap 466 (and compliance of the second contact finger 310) may permit this deflection without a significant increase in the frictional forces generated.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and/or the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical contact comprising:

a base portion; and a mating portion having a leading end of the electrical contact, the mating portion including first and second contact fingers coupled to the base portion and extending between the base portion and the leading end, the first and second contact fingers opposing each other with a contact-receiving space therebetween, the first contact finger having an engagement surface that is shaped to define a primary contact zone;

a resonance-control protrusion shaped to define a stub-contact zone, wherein the stub-contact zone is positioned at the base portion or between the base portion and the primary contact zone, wherein the primary contact zone and the stub-contact zone are configured to engage another contact, the stub-contact zone configured to impede electrical resonance along a stub portion of the other contact, wherein the first contact finger has a contact width defined between two edge segments that face away from each other, the resonance-control protrusion including one of the edge segments of the contact finger.

2. The electrical contact of claim 1, wherein the first contact finger is deflected by the other contact during a mating operation in which the primary contact zone wipes along a surface of the other contact, the primary contact zone and the stub-contact zone facing in a common direction, wherein the first contact finger is in a deflected state as the primary contact zone engages the other contact and wipes along the surface of the other contact, the stub-contact zone configured to engage the surface of the other contact while the first contact finger is in the deflected state.

3. The electrical contact of claim 1, wherein the contact finger is stamped-and-formed from sheet material, the resonance-control protrusion being an embossed region of the sheet material such that resonance-control protrusion is formed by an abrupt change in an elevation of the sheet material without an abrupt increase in a width of the contact finger.

4. The electrical contact of claim 1, wherein the resonance-control protrusion has a protrusion width that is less than the contact width of the contact finger, wherein the resonance-control protrusion does not abruptly increase the contact width of the contact finger.

5. The electrical contact of claim 1, wherein the first contact finger has a contoured end segment that extends between the primary contact zone and the leading end of the electrical contact and wherein the second contact finger has a contoured end segment that extends between the contact zone of the second contact finger and the leading end of the electrical contact, the contoured end segment of the first contact finger being longer than the contoured end segment of the second contact finger.

6. The electrical contact of claim 1, wherein the contact finger includes the resonance-control protrusion such that the resonance-control protrusion is positioned between the base portion and the primary contact zone and moves relative to the base portion when the contact finger is deflected.

7. The electrical contact of claim 1, wherein the second contact finger is devoid of a resonance-control protrusion.

8. The electrical contact of claim 1, wherein the first and second contact fingers converge toward the longitudinal axis and first and second convergence angles, the first convergence angle being greater than the second convergence angle such that the first contact finger converges toward the longitudinal axis more quickly than the second contact finger.

9. The electrical contact of claim 1, wherein the first contact finger provides a greater resistance to being deflected than the second contact finger.

10. An electrical connector comprising:

a connector housing configured to engage another connector and having an interior surface; and a plurality of electrical contacts coupled to the connector housing, each of the electrical contacts of the plurality of electrical contacts comprising:

a base portion; and a mating portion having a leading end of the electrical contact, the mating portion including a contact finger coupled to the base portion and extending between the base portion and the leading end, the contact finger having an engagement surface that is shaped to define a primary contact zone, wherein the contact finger is a first contact finger and the mating portion of each of the electrical contacts includes a second contact finger, the second contact finger coupled to the base portion and extending between the base portion and the leading end, the second contact finger having a corresponding engagement surface that is shaped to define a corresponding contact zone, the first and second contact fingers opposing each other with a contact-receiving space therebetween;

a resonance-control protrusion shaped to define a stub-contact zone of the first contact finger, wherein the stub-contact zone is positioned at the base portion or between the base portion and the primary contact zone, wherein the primary contact zone and the stub-contact zone are configured to simultaneously engage another contact, the stub-contact zone configured to impede electrical resonance along a stub portion of the other contact;

wherein the second contact finger has a contoured end segment that extends between the contact zone of the second contact finger and the leading end of the electrical contact, the contoured end segment of the second contact finger and the interior surface of the connector housing being shaped relative to one another such that a flex gap exists between the contoured end segment of the second contact finger and the interior surface of the connector housing, wherein the second contact finger is permitted to move within the flex gap during a mating operation.

11. The electrical connector of claim 10, wherein the first contact finger is deflected by the other contact during a mating operation in which the primary contact zone wipes along a surface of the other contact, wherein the first contact finger is configured to have a deflected state as the primary contact zone engages the other contact and wipes along the surface of the other contact, the stub-contact zone configured to engage the surface of the other contact while the first contact finger is in the deflected state.

12. The electrical connector of claim 10, wherein the first contact finger includes a contoured end segment that is configured to engage the interior surface of the connector housing as the first contact finger is deflected by the other contact during a mating operation, the interior surface blocking movement of the contoured end segment of the first contact finger while permitting the first contact finger to bow when the stub-contact zone engages the other contact.

13. The electrical connector of claim 10, wherein the first contact finger is stamped-and-formed from sheet material, the resonance-control protrusion being an embossed region of the sheet material such that resonance-control protrusion is formed by an abrupt change in an elevation of the sheet material without an abrupt increase in a width of the first contact finger.

14. The electrical connector of claim 10, wherein the first contact finger has a contact width defined between two edge segments that face away from each other, the resonance-control protrusion having a protrusion width that is less than the contact width of the first contact finger, wherein the resonance-control protrusion does not abruptly increase the contact width of the first contact finger.

15. The electrical connector of claim 10, wherein the first contact finger provides a greater resistance to being deflected than the second contact finger.

16. The electrical connector of claim 10, wherein the contoured end segment of the first contact finger is sized and shaped differently than the contoured end segment of the second contact finger.

17. A communication system comprising:

a mating connector having a plurality of mating contacts; and an electrical connector comprising a connector housing and a plurality of electrical contacts coupled to the connector housing, each of the electrical contacts of the plurality of electrical contacts comprising:

a base portion; and a mating portion having a leading end of the electrical contact, the mating portion including a contact finger coupled to the base portion and extending between the base portion and the leading end, the contact finger having an engagement surface that is shaped to define a primary contact zone;

a resonance-control protrusion shaped to define a stub-contact zone, wherein the stub-contact zone is positioned at the base portion or between the base portion and the primary contact zone;

wherein the primary contact zone and the stub-contact zone are configured to simultaneously engage a respective mating contact of the mating connector, the stub-contact zone configured to impede electrical resonance along a stub portion of the respective mating contact;

wherein the contact finger has a contoured end segment that extends between the primary contact zone and the leading end of the electrical contact, the connector housing having an interior surface, wherein the contoured end segment is configured to engage the interior surface of the connector housing as the contact finger is deflected by the respective mating contact during a mating operation, the interior surface blocking movement of the contoured end segment while permitting the contact finger to bow when the stub-contact zone engages the respective mating contact.

18. The communication system of claim 17, wherein the contact finger is deflected by the respective mating contact during a mating operation in which the primary contact zone wipes along a surface of the respective mating contact, the primary contact zone and the stub-contact zone facing in a common direction, wherein the contact finger is configured to have a deflected state as the primary contact zone engages the respective mating contact and wipes along the surface of the other contact, the stub-contact zone configured to engage the surface of the respective mating contact while the contact finger is in the deflected state.

19. The communication system of claim 17, wherein the contact finger is stamped-and-formed from sheet material, the resonance-control protrusion being an embossed region of the sheet material such that resonance-control protrusion is formed by an abrupt change in an elevation of the sheet material without an abrupt increase in a width of the contact finger.

* * * * *